US009127840B2

(12) United States Patent
Fandrich

(10) Patent No.: US 9,127,840 B2
(45) Date of Patent: Sep. 8, 2015

(54) METHODS AND DEVICES FOR PRODUCING FIRE TINDER

(75) Inventor: Roger Fandrich, Las Vegas, NV (US)

(73) Assignee: THE PATHFINDER SCHOOL LLC, Indianapolis, IN (US)

( * ) Notice: Subject to any disclaimer, the term of this patent is extended or adjusted under 35 U.S.C. 154(b) by 675 days.

(21) Appl. No.: 13/529,840

(22) Filed: Jun. 21, 2012

(65) Prior Publication Data

US 2012/0328995 A1 Dec. 27, 2012

Related U.S. Application Data

(60) Provisional application No. 61/499,208, filed on Jun. 21, 2011, provisional application No. 61/589,970, filed on Jan. 24, 2012.

(51) Int. Cl.
*F23Q 13/00* (2006.01)
*C10L 11/06* (2006.01)

(52) U.S. Cl.
CPC ..... *F23Q 13/00* (2013.01); *C10L 11/06* (2013.01)

(58) Field of Classification Search
CPC ..... C10L 11/06; F23Q 13/00
See application file for complete search history.

(56) References Cited

U.S. PATENT DOCUMENTS

| | | | | |
|---|---|---|---|---|
| 2,094,661 | A * | 10/1937 | Macleay et al. | 44/519 |
| 4,074,977 | A * | 2/1978 | Dunham et al. | 44/531 |
| 4,725,286 | A | 2/1988 | Brame | |
| 5,830,245 | A | 11/1998 | Raddon | |
| 7,399,324 | B2 * | 7/2008 | Roddenbery et al. | 44/530 |
| 2002/0129808 | A1 | 9/2002 | Manner | |
| 2006/0117649 | A1 | 6/2006 | Schweickhardt | |
| 2006/0236599 | A1 * | 10/2006 | Lehman | 44/542 |

OTHER PUBLICATIONS

Reid Hyken, Knives Ship Free Fire Kit, webpage, 2009, 6 pages, available online at http://www.ksfinfo.com/reviews/hyken_ksf_fire_kit_review.html.

* cited by examiner

*Primary Examiner* — Cephia D Toomer
(74) *Attorney, Agent, or Firm* — D'Hue Law LLC; Cedric A. D'Hue

(57) ABSTRACT

Fire starters are disclosed. Methods of using the fire starter are disclosed. Methods of producing fire starters are also disclosed.

19 Claims, 5 Drawing Sheets

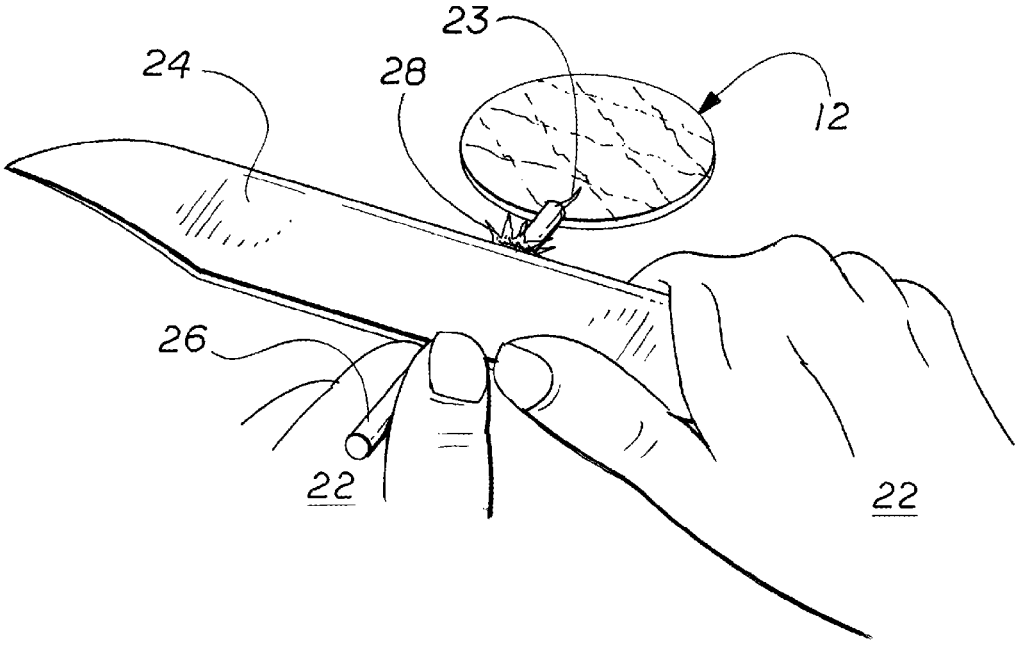
Fig. 2B
Fig. 3
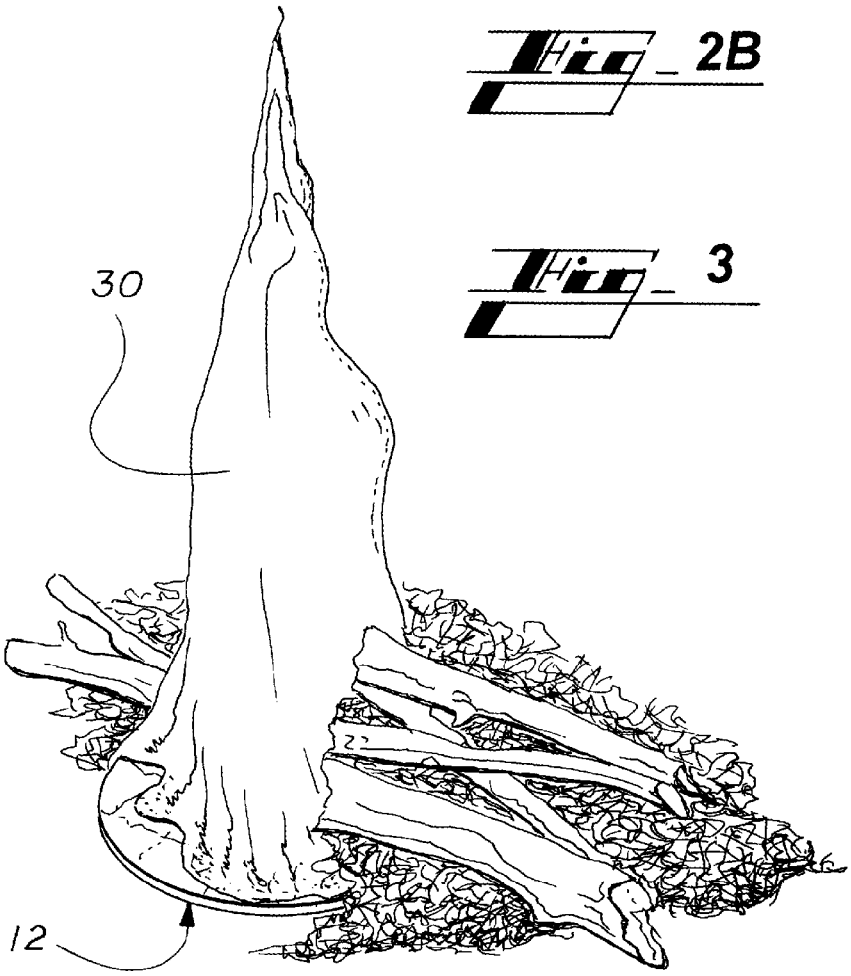

METHODS AND DEVICES FOR PRODUCING FIRE TINDER

REFERENCE TO RELATED APPLICATION

This application claims the benefit of U.S. Provisional Patent Application Ser. No. 61/499,208, filed on Jun. 21, 2011, under the title "Method and Device for Producing Fire Tinder," and U.S. Provisional Patent Application Ser. No. 61/589,970, filed on Jan. 24, 2012, under the title "Methods and Devices for Producing Fire Tinder," the disclosures of which are expressly incorporated by reference.

FIELD

The present disclosure includes fire starters, the method of using the fire starter and corresponding methods of producing fire starters.

BACKGROUND

Typically a fire is started by placing dry kindling wood and similar easily lit objects below a stack of wood or other fire sustaining fuel source. The easily lit objects are ignited and this smaller fire ignites the stack of wood. Several factors may hamper success of this traditional fire starting system. Weather conditions, the amount and condition of easily lit objects (such as dry kindling wood), and the experience of the fire starting individual all play a role in the success or failure to start a fire.

Weather conditions, such as cold temperature, rain or snow, wet or frozen ground, and high wind, can have a dampening effect on starting a fire. A lack of easily lit objects due to several factors, such as terrain or recent rain or snow, can also hamper efforts to start a fire. Finally, an inexperienced fire starting individual may not be prepared based on limited skill or training on how to start a fire under multiple conditions or challenging situations.

Alternative methods of starting fires have been disclosed which seek to minimize the effect of weather conditions, remove the requirement for easily lit objects, and to provide sufficient guidance to the fire starting individual. Most alternative methods utilize liquid fuel or solid fuel fire starters. Some alternative methods provide a small amount of easily lit objects kept in a waterproof container. Most alternative methods come with instructions on lighting the easily lit object in order to start a fire.

SUMMARY

The present disclosure includes a fire starter comprising a round cotton disk, and paraffin wax surrounding the round cotton disk, wherein the paraffin wax includes lighter fluid forming a mixture.

The present disclosure also includes a method of starting a fire using a fire starter, wherein the fire starter includes a round cotton disk and paraffin wax surrounding the round cotton disk, the method comprising the steps of exposing a portion of the round cotton disk and igniting the exposed portion.

The present disclosure also includes a method of making a fire starter. The method comprising the steps of providing a round cotton disk and paraffin wax, melting paraffin wax, adding lighter fluid to the melted paraffin wax, wherein the lighter fluid is at least partially soluble in melted paraffin wax, adding the round cotton disk into a mixture of lighter fluid and melted paraffin wax, compressing the disk into the mixture in order to ensure the disk absorbs the mixture, removing the mixture impregnated round cotton disk, cooling the mixture impregnated round cotton disk to a semi firm state, and storing the semi firm disk in a container until disk reaches room temperature.

BRIEF DESCRIPTION OF THE DRAWINGS

The above-mentioned and other features of this disclosure, and the manner of attaining them, will become more apparent and the disclosure itself will be better understood by reference to the following description of embodiments of the disclosure taken in conjunction with the accompanying drawings, wherein:

FIG. 2B is a perspective view of an individual attempting to start a fire with a torn fire starter of FIG. 2A.

FIG. 3 is a perspective view of a fire fueled by the fire starter of FIG. 2B and a stack of wood.

Figure 1:
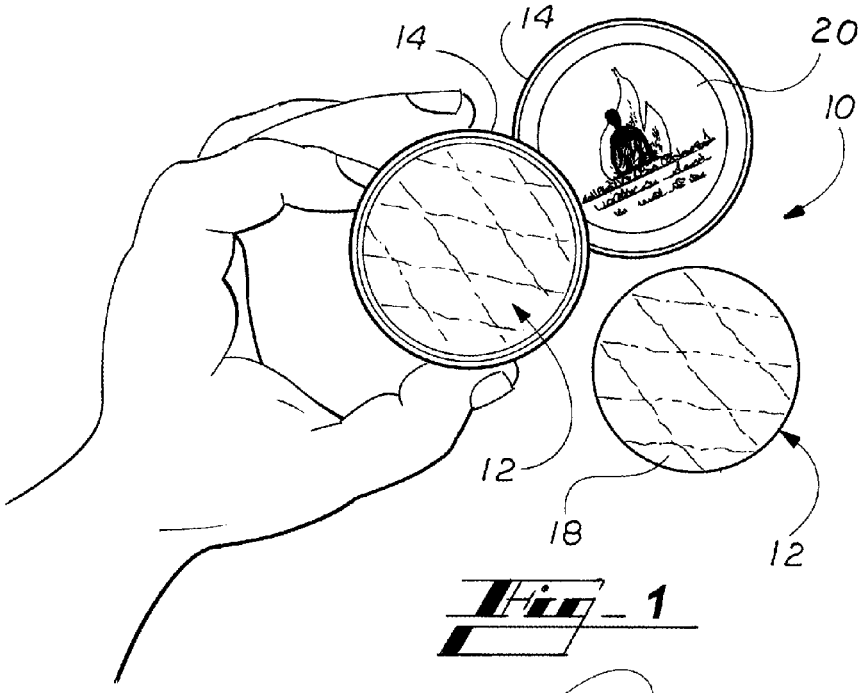
FIG. 1 is a perspective view of the fire starter and holder according to an embodiment of the present disclosure.
Figure 1A:
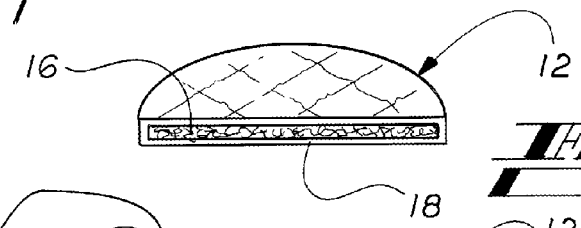

Corresponding reference characters indicate corresponding parts throughout the several views. Although the drawings represent embodiments of the present disclosure, the drawings are not necessarily to scale and certain features may be exaggerated in order to better illustrate and explain the present disclosure.

DETAILED DESCRIPTION OF THE EXEMPLARY EMBODIMENTS

The embodiments disclosed below are not intended to be exhaustive or limit the disclosure to the precise forms disclosed in the following detailed description. Rather, the embodiments are chosen and described so that others skilled in the art may utilize their teachings.

As shown in FIG. 1, fire starter kit 10 includes fire starting disk 12 and disk holder 14 (also described as container 14). Fire starting disk 12 is comprised of round cotton disc 16, paraffin wax 18 with lighter fluid. As described in greater detail below according to a method of making fire starting disk 12, mixture 18 of paraffin wax and lighter fluid is impregnated on round cotton disc 16.

Specific to one embodiment of the present disclosure, round cotton disc 16 is a commercially available product generally described as 100% Cotton Rounds. 100% Cotton Rounds are commercially available by several manufacturers. One such manufacturer is Delon Laboratories of Québec, Canada which offers 100% Cotton Rounds online at: www.labdelon.com/products.php?cat=Cotton Products.

Specific to one embodiment of the present disclosure, paraffin wax is a commercially available product. Paraffin wax is a commercially available by several manufacturers. One such manufacturer is Royal Oak Enterprises of Roswell, Ga. which offers paraffin wax, under the trademark Parowax®, online at: Amazon.com. Paraffin is generally described as any alkane including hydrocarbons with the general formula $C_nH_{2n+2}$. Paraffin wax is generally described as any mixture of alkanes wherein most alkanes fall within the range of approximately twenty to approximately forty carbons.

One advantage of paraffin wax is its insolubility with water. This insolubility makes fire starter 12 waterproof. This insolubility allows fire starter 12 to be submersed in water without significant adverse effect upon fire starting ability. This insolubility also allows fire starter 12 to float on water.

Specific to one embodiment of the present disclosure, lighter fluid may refer to several different types of commercially available products, including cigarette lighter fluid, wick type lighter fluid, and charcoal lighter fluid. All forms of lighter fluid are envisioned for the scope of this disclosure. Cigarette lighter fluid is typically comprised of butane. Wick type lighter fluid is typically comprised of naphtha, a hydrocarbon mixture. Charcoal lighter fluid is typically comprised of a mixture of petroleum distillates. One such manufacturer of charcoal lighter fluid is Kingsford Products Company of Oakland, Calif. which offers charcoal lighter fluid online at: www.kingsford.com/products/details/kingsford-charcoal-lighter-fluid/.

As shown in FIG. 1, disk holder 14 is illustrated as a sheet metal container. In this illustrative embodiment, disk holder 14 is shown as a round container with a screw top cover. Specific to one embodiment of the present disclosure, disk holder 14 is a two ounce (2 oz.) Tin Flat Container. Two ounce Tin Flat Containers are commercially available by several manufacturers. One such manufacturer is Specialty Bottle of Seattle, Wash. which offers a two ounce Tin Flat Container identified as TNF2.

Disk holder 14 is useful in storing fire starting disk 12. Disk holder 14 is configured for safe storage of fire starting disk 12. For example, disk holder 14 includes screw top lid 20 to help ensure safe storage of any item including items such as fire starting disk 12. Disk holder 14 is ergonomically sized for an adult user's hands, making screw top lid 20 easier to open by an adult including under challenging physical or environmental conditions such as cold hands and/or numb fingers.

Disk holder 14 is also useful for several other functions. Polished disk holder 14 or screw top lid 20 can be used with light to signal, to transmit information by signals, and to provide location information of the holder, such as in an emergency situation. Closed disk holder 14 reflects sunlight which is helpful to safely store fire starting disk 12 in direct sunlight. After burning fire starting disk 12 in disk holder 14, disk holder 14 and fabric (not shown) may be used to create char cloth.

In operation, fire starter 12 is torn, ignited and burned in order to assist a fire starting individual to build sustainable fire 30 including under the most challenging environmental conditions. The first step in starting fire 30 using fire starter 12 is opening disk holder 14 and selecting either one fire starter 12 or a plurality of fire starters 12.

Figure 2A:
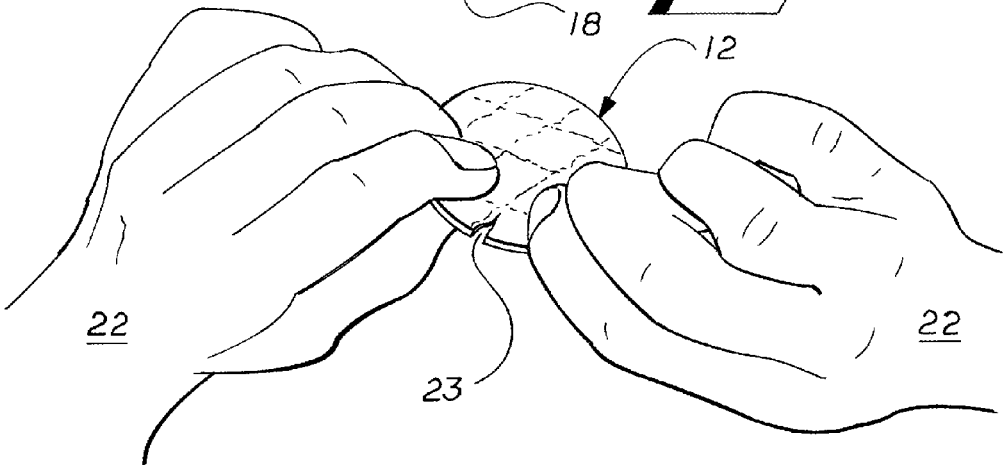
FIG. 2A is a perspective view of the hands of a fire starting individual tearing the fire starter of FIG. 1.

The second step in starting fire 30 using fire starter 12 is to expose portion 23 of underlying round cotton disk 16. Exposing can be accomplished by a number of ways. As illustrated in FIG. 2A, hands 22 of a fire starting individual are tearing fire starter 12 in order to expose round cotton disk 16. As illustrated in FIG. 4B, hands 22 of a fire starting individual are rubbing fire starter roll 120 in order to expose portion 230 of cotton roll 160. Similar to FIG. 2B, fire starter 120 includes exposed portion 230 of round roll 160 and fire starting individual is creating sparks to ignite fire starter 12. Specifically, fire starting individual holds knife 24 in one hand 22 and rod 26 in the other hand 22. By striking knife 24 and rod 26, fire starting individual is able to create and direct sparks 28 toward exposed portion 230 of fire starter 120. Fire starter 120 is configured to ignite when sparks engage exposed portion 230 of fire starter 120.

It is envisioned that any way to expose underlying round cotton disk 16 or cotton roll 160 is appropriate including as examples: scratching, cutting, splitting, bending to rupture, cracking, or ripping.

Fire starting individual may chose to tear off a portion of fire starter 12. A portion of fire starter 12 can be as small or as large a piece of fire starter 12 as needed by fire starting individual. As multiple illustrative embodiments of the present disclosure, fire starting individual may choose to tear off a fourth, a third, or half of fire starter 12. Fire starting individual may choose to retain the remainder of fire starter 12 for future use. Several factors may cause fire starting individual to choose to use a portion of fire starter 12. Fire starting individual may chose to use only what is needed to start fire 30. Fire starting individual may chose to minimize smoke production. Fire starting individual may need to build several fires 30 and does not have enough whole fire starters 12 to accomplish the task. Fire starting individual may chose to tear fire starter 12 at multiple locations or into multiple portions 23 in order to expose more than one area of round cotton disk.

As shown in FIG. 2B, fire starter 12 is torn to expose portion 23 of round cotton disk 16 and fire starting individual is creating sparks to ignite fire starter 12. Specifically, fire starting individual holds knife 24 in one hand 22 and rod 26 in the other hand 22. By striking knife 24 and rod 26, fire starting individual is able to create and direct sparks 28 toward exposed portion 23 of fire starter 12. Fire starter 12 is configured to ignite when sparks engage exposed portion 23 of fire starter 12.

As shown in FIG. 3, fire starter 12 begins to burn the entire disk including round cotton disk 16 and the mixture 18 of paraffin wax and lighter fluid. Fire starter 12 is configured to produce fire 30 which can be used to create sustainable fire 30 even under the most challenging environmental conditions. An individual fire starter 12 disk tends to burn within the range of approximately five minutes to approximately seven minutes. Fire starter 12 disks that have been significantly exposed or torn into portions might burn for shorter or longer periods of time.

Portions of fire starter 12 may be used to build fires 30 under less challenging environmental conditions. It is envisioned that even though fire starter 12 has been ignited to create fire 30, fire starting individual or others may chose to snuff out the fire burning on fire starter 12. Snuffing out fire 30 might be done in order to reuse portion of fire starter 12.

Multiple fire starters 12 may be used to build fire 30 for an extended period of time. A stack of six fire starter 12 disks tends to burn for at least forty seven minutes.

In order to describe the method of making fire starter 12, the following Manufacturing Process illustrates an embodiment of the method of making fire starter 12.

Manufacturing Process of the Fire Starting disk:

Place one pound (1 lbs.) of Parowax Household Paraffin Wax in a large cooking pot and place on an electric stove burner. Set the initial temperature of the electric stove burner to "high." When the paraffin wax block(s) begin to melt rapidly, then decrease heat to the middle setting on the electric stove. When the paraffin wax block(s) has almost completely melted, decrease the electric stove temperature to the lowest setting. When the paraffin wax block(s) are completely melted, immediately turn the electric stove burner completely off.

Carefully move the cooking pot, containing the melted paraffin wax, to a safe working area.

Add four (4) drops of Liquid Candle Dye to the cooking pot of melted paraffin wax. It is envisioned that any color can be utilized. In this illustrative embodiment, the color Red/Pink has been used. Red/Pink Liquid Candle Dye is commercially available by several manufacturers. One such manufacturer is Peak Candle Supplies of Denver, Colo. which offers Red/Pink Concentrated Liquid Candle Dye. Thoroughly mix dye into melted paraffin wax until a stable color has been reached.

Using a measuring cup, add fifteen and one half ounces (15.5 oz.) of lighter fluid to the now colored melted wax mixture 18. Stir mixture 18 thoroughly and rapidly move to the next step.

Rapidly place any number of cotton rounds 16, such as two hundred and forty (240), individually separated, 100% cotton rounds 16, into the colored melted wax mixture 18. Stir and compress cotton rounds 16 into the colored melted wax mixture 18 to ensure that each cotton round 16 quickly absorbs an equal amount of the wax mixture 18. All cotton rounds 16 should be separated and loosely piled randomly in an unorganized single pile before cotton rounds 16 are placed into the colored melted wax mixture 18.

Immediately remove fire starter disks one by one and place disks on a solid cool surface, such as aluminum foil, cookie sheet or stainless steel countertop. The disks should lay as flat as possible until cooled. Use speed during this step to not allow the disks to cool before they are individually removed from the colored melted wax mixture 18, separated and placed flat on the cooling surface.

Once all disks have been removed and placed flat on the cooling area, let the disks cool at room temperature until a semi firm disk has been created. It is best to not allow disks to cool too much. When removing the disks from the cooling area, the disk should detach from the surface with a moderate amount of resistance. It too much effort is required to remove the cooled disks, then the disks have cooled too much. The disks may be gently re-warmed slightly, using a portable heat source such as a simple hair dryer or other immediate heat source.

Randomly store disks in a large container until the disks 12 completely cool to room temperature.

Packaging of the Fire Starter disks 12:

Inspect each disk 12. Remove any excess wax chunks or buildup. Stack six disks in a straight and neat arrangement. Compress stack of disks by hand and place compressed stack inside two ounce (2 oz.) Tin Flat Container with a Screw Top Cover. Clean and polish container to ensure polished surfaces for container. Attach label to Screw Top Cover. Attach directions and warning labels on the bottom side of container. Lightly polish container. Insert heat shrink bands over the container and heat until a tight seal has been achieved. Box up multiple containers and prepare for shipping.

Figure 4:
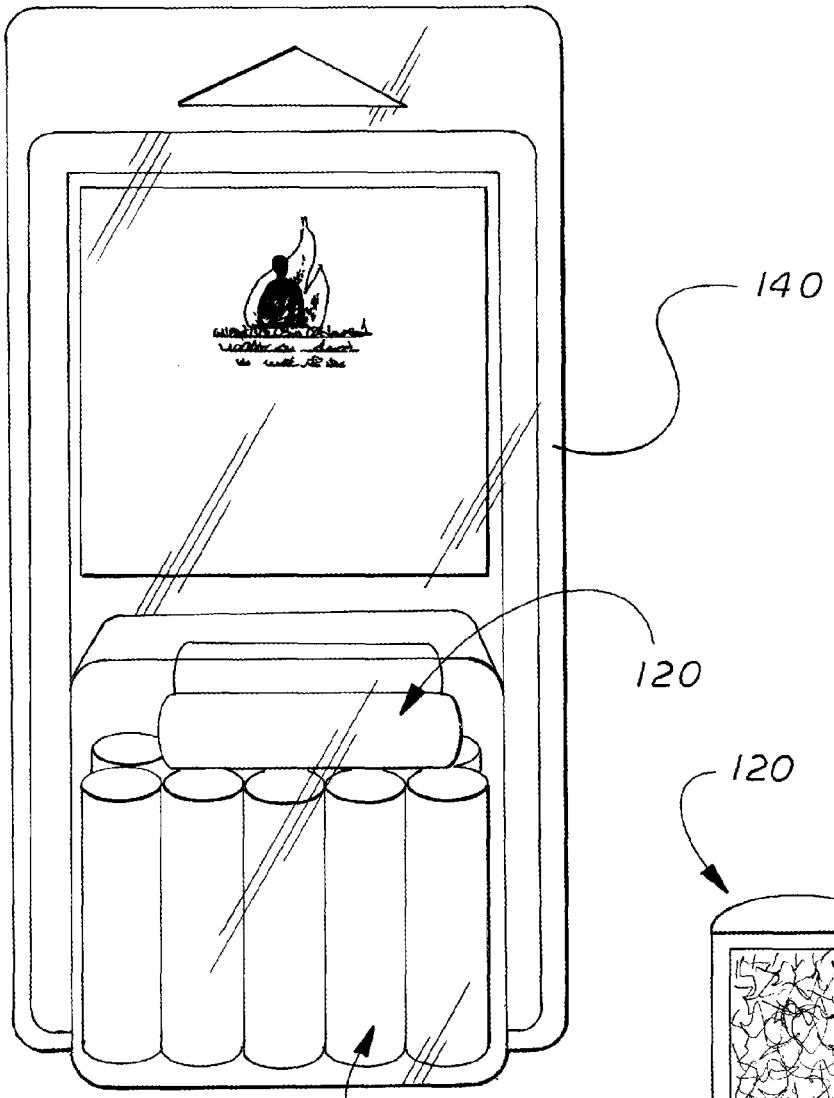
FIG. 4 is a perspective view of a plurality of fire starters and container according to a second embodiment of the present disclosure.
Figure 4A:
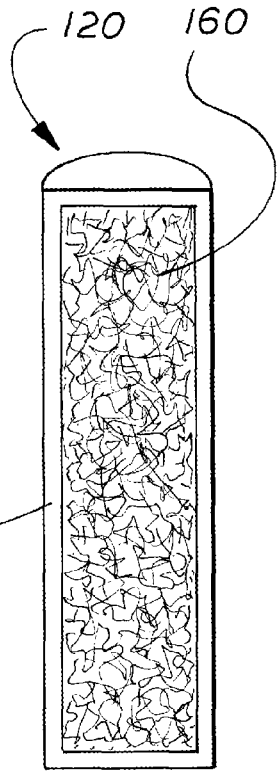
Figure 4B:
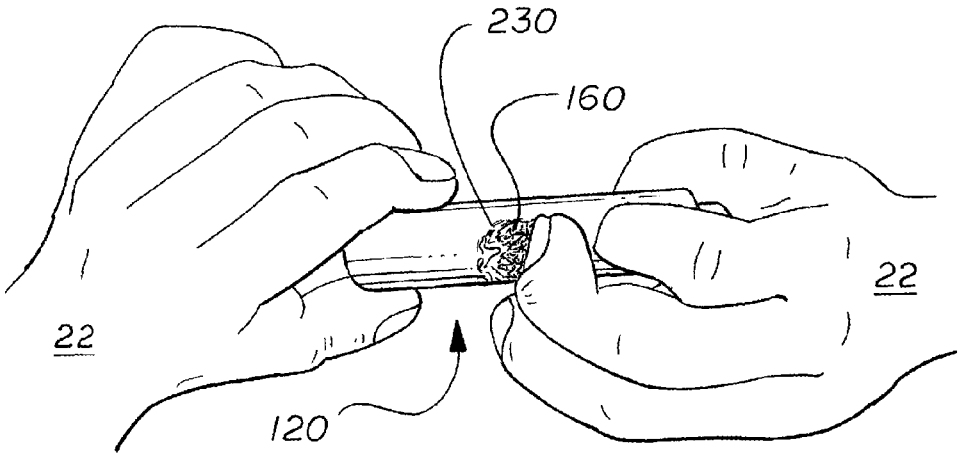
Figure 4C:
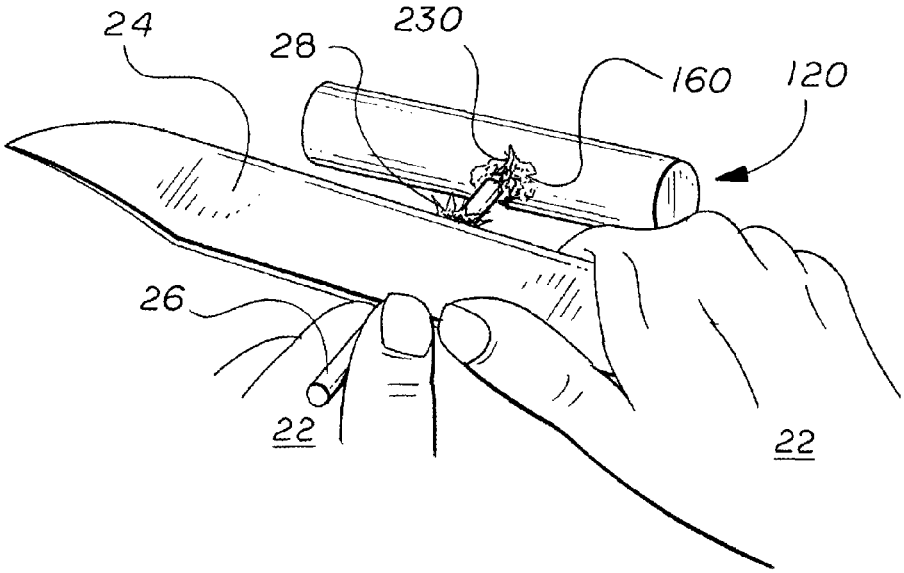

As shown in FIG. 4, a second embodiment of fire starters are shown. Several aspects of the second embodiment are similar to the previously described first embodiment. Only significant differences are discussed in detail. The second embodiment fire starters are comprised of cylindrical cotton rolls 160. Specific to this embodiment of the present disclosure, cylindrical cotton rolls 160 are a commercially available product generally used in dental procedures. Cylindrical Cotton Rolls 160 are commercially available by several manufacturers.

Packaging of the Fire Starter Rolls 120:

Inspect each fire starter 120. Remove any excess wax chunks or buildup. Arrange twelve fire starters in container 140 such as a standard clamshell package 140. Insert directions in container and attach warning labels to container. Seal or close container. Box up multiple containers and prepare for shipping.

Manufacturing Process of Fire Starter Rolls 120:

Place three pounds (3 lbs.) of Parowax Household Paraffin Wax in a large cooking pot and place on an electric stove burner. Set the initial temperature of the electric stove burner to "high." When the paraffin wax block(s) begin to melt rapidly, then decrease heat to the middle setting on the electric stove. When the paraffin wax block(s) has almost completely melted, decrease the electric stove temperature to the lowest setting. When the paraffin wax block(s) are completely melted, immediately turn the electric stove burner completely off.

Carefully move the cooking pot, containing the melted paraffin wax, to a safe working area.

Add sixteen (16) drops of Liquid Candle Dye to the cooking pot of melted paraffin wax. Thoroughly mix dye into melted paraffin wax until a stable color has been reached.

Using a measuring cup, add fourteen ounces (14 oz.) of lighter fluid to the now colored melted wax mixture. Stir mixture thoroughly and rapidly move to the next step.

Rapidly place any number of cotton rolls, such as four hundred (400), individually separated, 100% cotton rolls 160, into the colored melted wax mixture. Stir and compress cotton rolls 160 into the colored melted wax mixture to ensure that each cotton roll quickly absorbs an equal amount of the wax mixture. All cotton rolls 16 should be separated and loosely piled randomly in an unorganized single pile before cotton rolls 16 are placed into the colored melted wax mixture.

Immediately remove fire starter rolls one by one and place rolls on a cooling bin or a solid cool surface, such as aluminum foil, cookie sheet or stainless steel countertop. Use speed during this step to not allow the rolls to cool before they are individually removed from the colored melted wax mixture, separated and placed flat on the initial cooling surface.

Once all rolls have been removed and placed in the initial cooling area, rolls are then moved to a larger surface area and spread out to cool at room temperature. Cylinders should completely cool to room temperature. For example, fire starter rolls should cool for at least approximately 6 hours at room temperature.

Randomly store rolls in a large container until the rolls 120 completely cool to room temperature.

Figure 5:
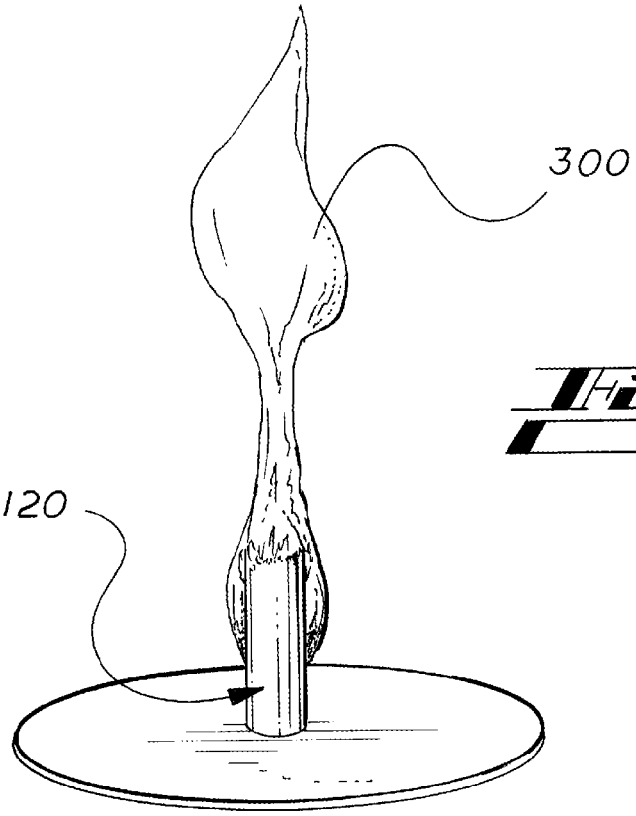
FIG. 5 is a perspective view of a fire fueled by the fire starter of FIG. 4 with the fire starter in a vertical orientation.
Figure 6:
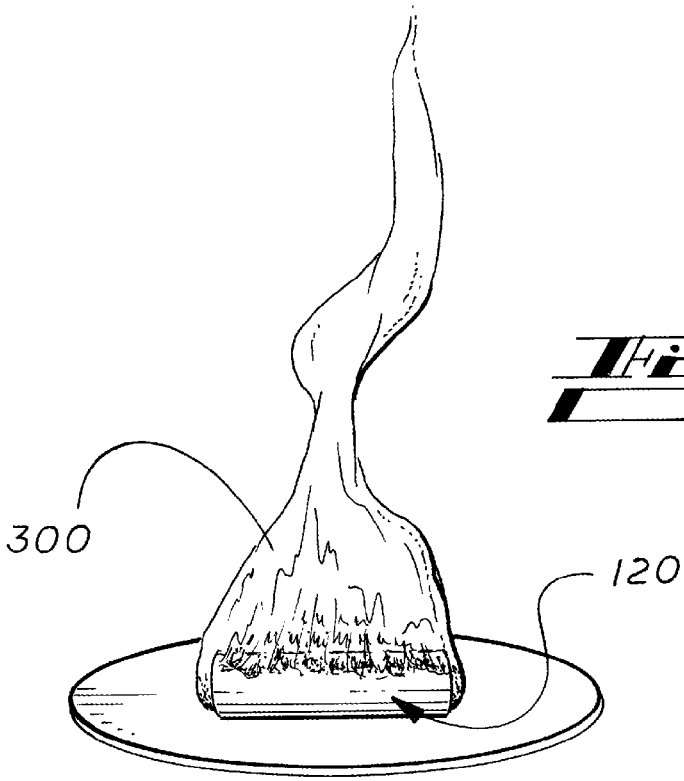
FIG. 6 is a perspective view of a fire fueled by the fire starter of FIG. 4 with the fire starter in a horizontal orientation.

As shown in FIGS. 5 and 6, fire starter roll 120 burns in either a vertical orientation (FIG. 5) and a horizontal orientation (FIG. 6). In a vertical orientation, fire starter roll 120 supports initial fire 300 which is taller and burns hotter than in a horizontal orientation. In a horizontal orientation, fire starter roll 120 fuels initial fire 300 which is wider and lasts longer than in a vertical orientation. Fire starter roll 120 is configured to produce initial fire 300 which can be used to create a sustainable fire even under the most challenging environmental conditions. One individual fire starter roll 120 tends to burn within the range of approximately four minutes to approximately five minutes. Multiple fire starters 120 may be used to build a fire for an extended period of time. A stack of six fire starter rolls 120 tend to burn for at least forty eight minutes.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. A fire starter comprising:

a cotton fiber, paraffin wax surrounding the fiber, wherein the paraffin wax includes lighter fluid.

2. The fire starter of claim 1, wherein the cotton is a round cotton disk or a cylindrical cotton roll.

3. The fire starter of claim 1 wherein the lighter fluid is charcoal lighter fluid.

4. The fire starter of claim 1, further comprising a fire starting kit including:

a plurality of fire starters, and a housing configured to store the plurality of fire starters.

5. The fire starter of claim 4 wherein the plurality of fire starters is within the range of approximately six fire starters per each housing to approximately twelve fire starters per each housing.

6. The fire starter of claim 4 wherein the housing is a two ounce (2 oz.) tin flat container with a screw top cover.

7. A method of starting a fire using a fire starter, the method comprising the steps of:

providing fire starter, wherein the fire starter includes a cotton fiber and paraffin wax mixed with lighter fluid surrounding the cotton fiber, exposing a portion of the cotton fiber and igniting the exposed portion.

8. The method of claim 7 wherein the step of exposing the portion of the cotton fiber includes the step of tearing the fire starter.

9. A method of making a fire starter, the method comprising the steps of:

providing a cotton fiber and paraffin wax, melting paraffin wax, adding lighter fluid to the melted paraffin wax, wherein the lighter fluid is at least partially soluble in melted paraffin wax, adding the cotton fiber into a mixture of lighter fluid and melted paraffin wax, compressing the cotton fiber into the mixture in order to ensure the fiber absorbs the mixture, removing the mixture impregnated cotton fiber, cooling the mixture impregnated cotton fiber to a semi firm state, and storing the semi firm mixture impregnated cotton fiber in a container once semi firm mixture impregnated cotton fiber reaches room temperature.

10. The method of claim 9, wherein the step of providing the cotton fiber includes the step of providing approximately two hundred and forty round cotton disks or the step of providing approximately four hundred cylindrical cotton rolls.

11. The method of claim 9, wherein the step of providing paraffin wax includes the step of providing within the range of approximately one pound to approximately three pounds of paraffin wax.

12. The method of claim 9, wherein the step of melting paraffin wax includes the steps of:

melting paraffin wax at a high temperature until paraffin wax begins to melt rapidly, melting paraffin wax at a medium temperature until almost all of paraffin wax has melted, melting paraffin wax at a low temperature until all of paraffin wax is melted, and removing melted paraffin wax from heat once all of paraffin wax has melted.

13. The method of claim 9, further comprising the step of adding dye to melted paraffin wax.

14. The method of claim 13 wherein the dye is candle dye.

15. The method of claim 14 wherein the dye is red or pink liquid candle dye.

16. The method of claim 13 wherein the step of adding dye to melted paraffin wax includes the step of adding within the range of approximately four drops to approximately sixteen drops of dye.

17. The method of claim 9 wherein the lighter fluid is charcoal lighter fluid.

18. The method of claim 9 wherein the step of adding lighter fluid to the melted paraffin wax includes the step of adding within the range of approximately fourteen ounces to approximately fifteen and one-half ounces of lighter fluid to the melted paraffin wax.

19. The method of claim 9 wherein the step of storing the plurality of semi firm fibers in the container includes the step of storing within the range of approximately six to approximately twelve semi firm fibers in the container.

* * * * *